US009494022B2

(12) United States Patent
Coates et al.

(10) Patent No.: US 9,494,022 B2
(45) Date of Patent: Nov. 15, 2016

(54) GAS RESTRICTOR FOR A HORIZONTALLY ORIENTED SUBMERSIBLE WELL PUMP

(71) Applicant: Baker Hughes Incorporated, Houston, TX (US)

(72) Inventors: Bryan C. Coates, Leduc (CA); Curtis J. Goulet, Lacombe (CA)

(73) Assignee: Baker Hughes Incorporated, Houston, TX (US)

( * ) Notice: Subject to any disclaimer, the term of this patent is extended or adjusted under 35 U.S.C. 154(b) by 478 days.

(21) Appl. No.: 14/162,490

(22) Filed: Jan. 23, 2014

(65) Prior Publication Data

US 2015/0204169 A1 Jul. 23, 2015

(51) Int. Cl.
*E21B 43/12* (2006.01)

(52) U.S. Cl.
CPC ..... *E21B 43/128* (2013.01)

(58) Field of Classification Search
CPC ... E21B 43/128; E21B 43/122; E21B 43/123
See application file for complete search history.

(56) References Cited

U.S. PATENT DOCUMENTS

| | | | | |
|---|---|---|---|---|
| 1,697,321 | A | 1/1929 | Marsh | |
| 2,517,198 | A | 8/1950 | Gilbert | |
| 2,665,644 | A | 1/1954 | Wells | |
| 2,665,645 | A | 1/1954 | Wells | |
| 2,748,719 | A | 6/1956 | Wells | |
| 3,741,298 | A | 6/1973 | Canton | |
| 5,588,486 | A | 12/1996 | Heinrichs | |
| 5,653,286 | A | 8/1997 | McCoy et al. | |
| 6,615,926 | B2 | 9/2003 | Hester et al. | |
| 6,715,556 | B2 * | 4/2004 | Mack | E21B 43/121 166/105 |
| 7,013,979 | B2 | 3/2006 | Richard | |
| 7,270,178 | B2 | 9/2007 | Selph | |
| 7,318,481 | B2 | 1/2008 | Richard | |
| 7,377,314 | B2 | 5/2008 | Gonzalez | |
| 7,766,081 | B2 | 8/2010 | Brown et al. | |
| 7,921,988 | B2 | 4/2011 | Kozman et al. | |
| 7,980,314 | B2 | 7/2011 | Mack | |
| 8,251,138 | B2 | 8/2012 | Bonner et al. | |
| 2007/0051509 | A1 * | 3/2007 | Selph | E21B 43/128 166/105 |
| 2010/0065280 | A1 * | 3/2010 | Tetzlaff | E21B 43/38 166/373 |
| 2010/0096140 | A1 * | 4/2010 | Mack | E21B 34/06 166/369 |
| 2012/0132440 | A1 | 5/2012 | Xu | |
| 2012/0152528 | A1 | 6/2012 | Greci | |
| 2016/0177666 | A1 * | 6/2016 | Van Dam | E21B 34/08 166/250.15 |

* cited by examiner

*Primary Examiner* — Robert E Fuller
*Assistant Examiner* — David Carroll
(74) *Attorney, Agent, or Firm* — Bracewell LLP; James E. Bradley

(57) ABSTRACT

A submersible pump assembly has a tubular intake housing containing intake housing ports. A gas restrictor is carried around the intake housing. The gas restrictor is an eccentric sleeve with a semi-cylindrical portion with a centerline coincident with the axis of the pump and extending around an upper portion of the intake housing. A counterweight portion connected with the semi-cylindrical portion has an outboard area farther from the centerline than the semi-cylindrical portion. A weight bar may be mounted to the counterweight portion. The gas restrictor is free to self orient relative to the intake housing due to gravity while the pump assembly is in the horizontal section of the well, with the semi-cylindrical portion overlying and blocking at least some of the intake housing ports on an upper portion of the intake housing.

20 Claims, 4 Drawing Sheets

GAS RESTRICTOR FOR A HORIZONTALLY ORIENTED SUBMERSIBLE WELL PUMP

FIELD OF THE DISCLOSURE

This disclosure relates in general to electrical submersible pumps for wells and in particular to a gas restricting sleeve for the pump intake that blocks an upper flow path into the intake.

BACKGROUND

Electrical submersible pumps (ESP) are widely used to pump hydrocarbon production wells. A typical ESP has a rotary pump driven by an electrical motor. A seal section is located between the pump and the motor to reduce a differential between the well fluid pressure on the exterior of the motor and the lubricant pressure within the motor. A drive shaft, normally in several sections, extends from the motor through the seal section and into the pump for rotating the pump.

Many hydrocarbon wells are now being drilled with a vertical portion leading into an inclined or horizontal section. The ESP will normally be positioned in the horizontal section of the well. Hydrocarbon wells often produce gas as well as liquid, which includes water and oil. Rotary pumps are less efficient when the well fluid contains gas than if pure liquid. Therefore, reducing the amount of gas entering the pump intake is desired.

In a horizontal well, the gas tends to flow in the upper portion of the horizontal casing with the liquid below. The pump intake normally is a tubular member with intake ports spaced circumferentially around. Prior to installation, an operator will not know which of the intake ports ends up on the upper side of the tubular member. It is known in the art to use various devices to block the intake ports on the upper side of the tubular member. However, improvements are always desired.

SUMMARY

The submersible pump assembly of this disclosure includes a plurality of modules secured together, the modules including a pump having a longitudinal axis and a motor for driving the pump. An intake assembly is operatively connected with the pump and comprises a tubular intake housing concentric with the axis, the intake housing containing a plurality of intake housing ports. A gas restrictor is carried around and rotatable relative to the intake housing. The gas restrictor comprises a semi-cylindrical portion having a semi-cylindrical portion centerline, the semi-cylindrical portion closely receiving the intake housing. A counterweight portion is connected with the semi-cylindrical portion, the counterweight portion being configured to place a center of gravity of the gas restrictor below the semi-cylindrical portion centerline, causing the semi-cylindrical portion to overlie and block at least one of the intake housing ports located in an upper portion of the intake housing while the pump assembly is horizontally oriented. At least one gas restrictor port in the gas restrictor admits well fluid to at least one of the intake housing ports located on a lower portion of the intake housing.

In the preferred embodiment, the gas restrictor port extends through the counterweight portion. Preferably, the semi-cylindrical portion extends at a single radius about the semi-cylindrical portion greater than 180 degrees. The counterweight portion has an outermost point that is located radially farther from the semi-cylindrical portion centerline than the semi-cylindrical portion.

In some of the embodiments, the counterweight portion comprises first and second side walls extending downward from opposite sides of the semi-cylindrical portion and joining each other at a distance from the semi-cylindrical portion centerline greater than a radius of the semi-cylindrical portion. The counterweight portion may have a weight bar having a weight bar centerline located farther from the semi-cylindrical portion centerline than the semi-cylindrical portion. The semi-cylindrical portion may have an outboard area that is at a radius from the semi-cylindrical portion centerline greater than a radius of the semi-cylindrical portion. The weight bar may be secured to an upward-facing surface of the outboard area. The gas restrictor port is located in outboard area.

The intake housing has a smaller outer diameter than adjoining modules of the submersible pump assembly. The counterweight portion has an outboard area that is located a distance from the axis than is less than a radius of the adjoining modules. A perforated outer housing may surround the intake housing, the outer housing being the same outer diameter as the adjoining modules.

DETAILED DESCRIPTION OF THE DISCLOSURE

Figure 1:
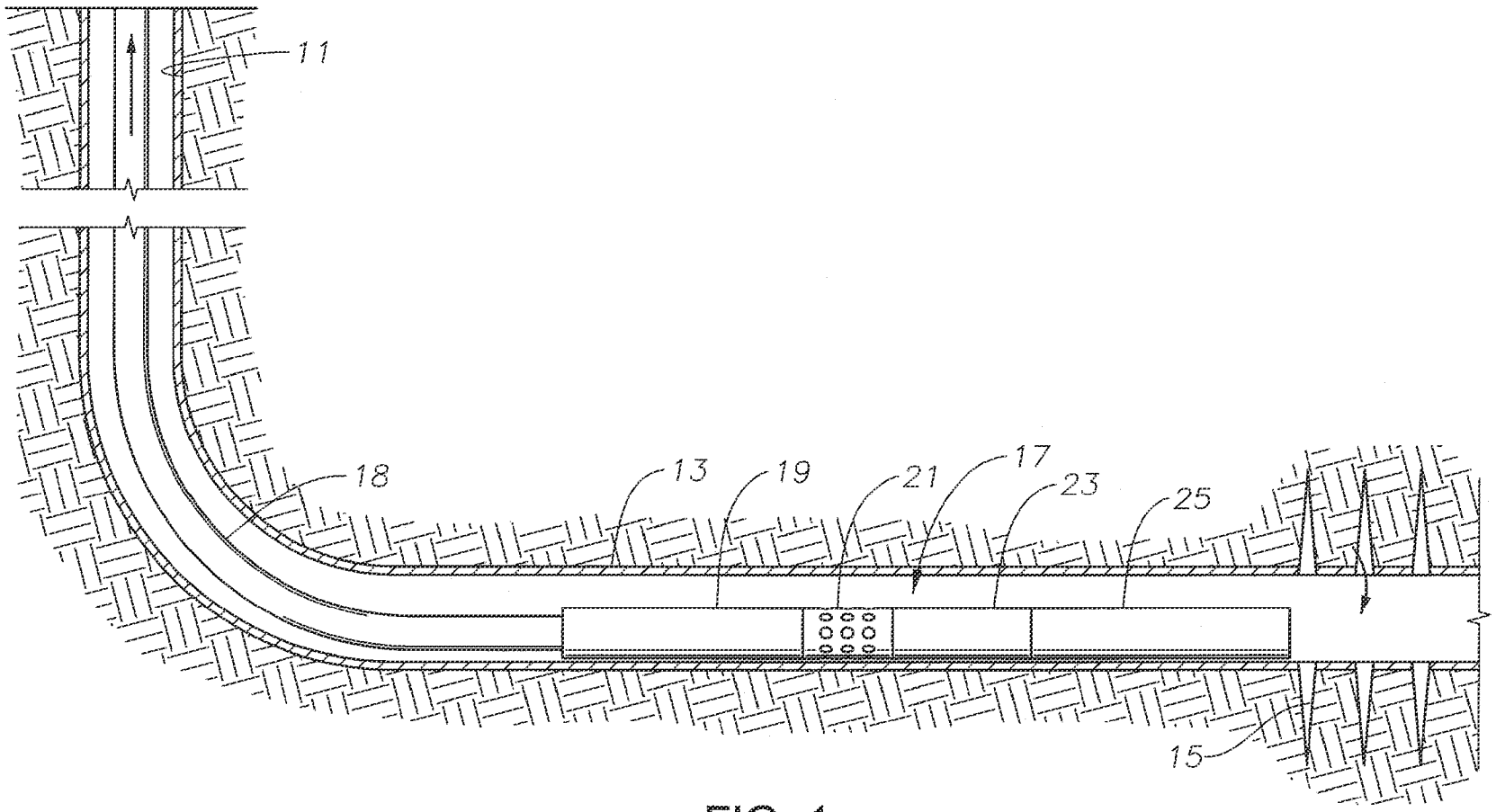
FIG. 1 is a schematic side view of an electrical submersible pump assembly in accordance with this disclosure installed within a horizontal section of a well.

Referring to FIG. 1, a well 11 has casing 13 with perforations 15 to admit well fluid. Well 11 has a vertical portion and an inclined portion, which may be horizontal. Perforations 15 are located in the inclined or horizontal portion of well 11. An electrical submersible pump assembly (ESP) 17 is illustrated as being supported on production tubing 18 extending into casing 13. Alternately, ESP 17 could be supported by other structure, such as coiled tubing. ESP 17 is located within the inclined or horizontal portion of well 11.

ESP 17 includes several modules, one of which is a pump 19 that may be a centrifugal pump having a large number of stages, each stage having an impeller and diffuser. Alternately, pump 19 could be another type, such as a progressing cavity pump having a helical rotor rotated within a helical bore of an elastomeric stator. Pump 19 has an intake assembly 21 for drawing in well fluid. A seal section 23 connects to intake assembly 21 in this example. In addition to seal section 23, another module is a motor 25, which drives pump 19 and is normally a three-phase AC motor. Seal section 23 is a protective member coupled between pump 19 and motor 25. Seal section 23 has components to reduce a pressure differential between dielectric lubricant contained in motor 25 and the hydrostatic pressure of the well fluid on the exterior of ESP 17. Intake assembly 21 may be located in an upper portion of seal section 23 or on a lower end of pump 19, or it may be a separate module.

ESP 17 may also include other modules, such as a gas separator for separating gas from the well fluid prior to the well fluid flowing into pump 19. If so, intake assembly 21 would be in the gas separator. The various modules may be shipped to a well site apart from each other, then assembled with bolts or other types of fasteners.

Figure 2:
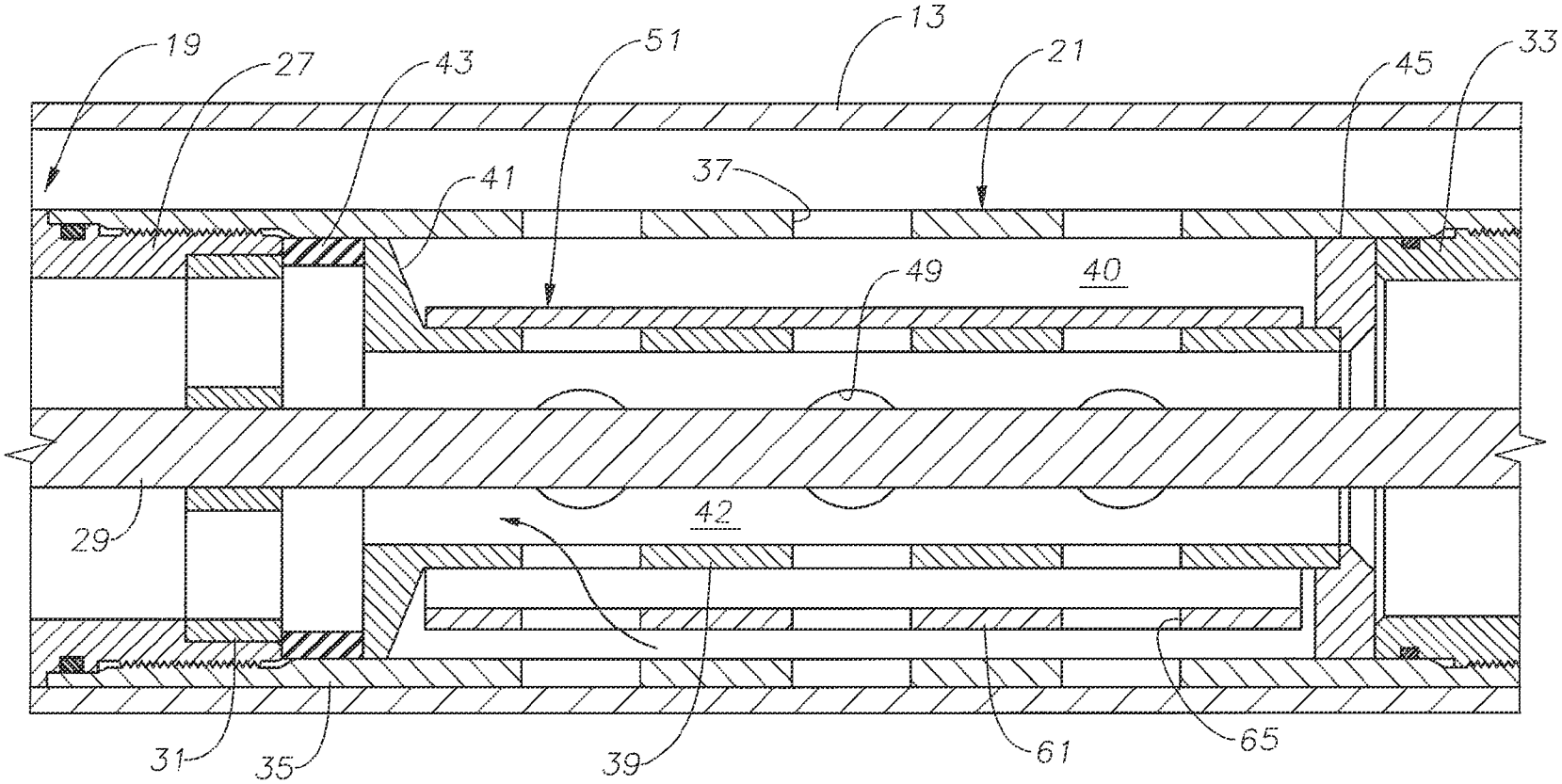
FIG. 2 is a longitudinal sectional view of a first embodiment of the intake of the pump assembly of FIG. 1, taken along the line 2-2 of FIG. 3, illustrating a first embodiment of a gas restrictor ring.

FIG. 2 illustrates one example of how intake assembly 21 connects within ESP 17, and many other arrangements are feasible. Referring to FIG. 2, pump 19 has an intake adapter 27 at its upstream end that secures by threads to a cylindrical housing of pump 19. A drive shaft 29 extends through pump 19 and is radially supported by radial bearings 31 (one shown). Motor 25 (FIG. 1) rotates drive shaft 29 to operate pump 19. Drive shaft 29 typically is in sections, each having a splined end and located within one of the modules of ESP 17. Intake assembly 21 is shown connected between pump intake adapter 27 and a seal section adapter 33 that connects to seal section 23 (FIG. 1).

Intake assembly 21 has a cylindrical outer housing 35 that has a downstream end secured by threads to pump intake adapter 27. Outer housing 35 may have the same outer diameter as pump 19 and seal section 23 (FIG. 1). Outer housing 35 has well fluid entry ports 37 spaced circumferentially around its side wall and along its length.

An inner housing 39, referred to herein as an intake housing, is concentrically mounted within outer housing 35. Shaft 29 extends concentrically through intake housing 39. The outer diameter of intake housing 39 is considerably smaller than the outer diameter of outer housing 35; for example the outer diameter of intake housing 39 may be about half of the outer diameter of outer housing 35, creating an outer annulus 40 between them. The inner diameter of intake housing 39 is considerably greater than the outer diameter of shaft 29, creating an inner annulus 42 between them. In this example, the inner diameter of intake housing 39 is more than twice the outer diameter of shaft 29, but that can be varied.

Various structure may be employed to mount intake housing 39 concentrically in outer housing 35. In this example, inner housing 39 has a first standoff end 41 joined to the downstream end of intake housing 39. First standoff end 41 has an outer diameter that is closely received in the inner diameter of outer housing 35. A seal ring 43 may be located between and sealing first standoff end 41 to the upstream end of pump intake adapter 27. A second standoff end 45 is shown on the upstream end of intake housing 39. Second standoff end 45 may be removable from intake housing 39. Second standoff end 45 also has an outer diameter closely received in the inner diameter of outer housing 35. Seal section adapter 33 abuts second standoff end 45 and exerts a downstream directed force on intake housing 39 that transmits through first standoff end 41 and seal ring 43 to intake adapter 27. Intake housing 39 has ports 49 spaced around its side wall and along its length.

Figure 3:
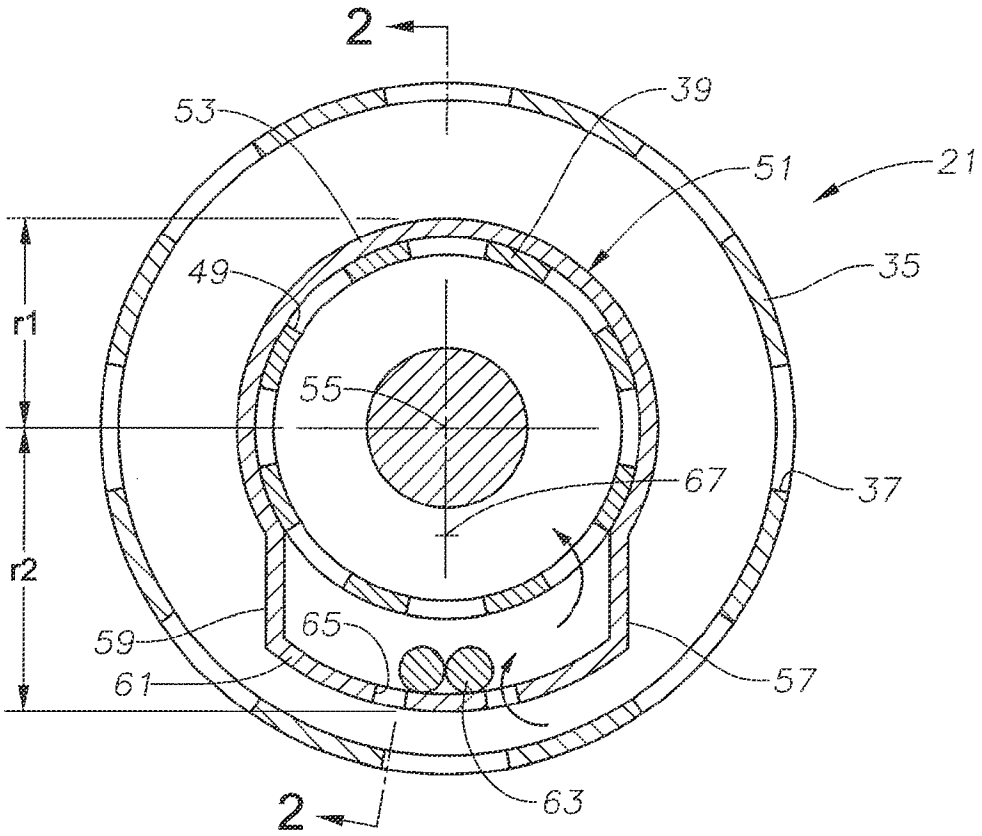
FIG. 3 is a transverse sectional view of the intake of the pump assembly of FIG. 2, with the well casing not shown.

A gas restrictor 51 is rotatably carried on intake housing 39 to block flow through ports 49 located in an upper portion of intake housing 39. Gas restrictor 51 extends approximately the length between first standoff end 41 and second standoff end 45. Referring to FIG. 3, gas restrictor 51 is an eccentric sleeve having a semi-cylindrical portion 53. Semi-cylindrical portion 53 has an inner diameter approximately the same as the outer diameter of intake housing 39 so that it closely and slidingly fits on intake housing 39 to blocks ports 49 in the upper portion of intake housing 39. Semi-cylindrical portion 53 is free of any apertures, thus will block or restrict flow through any ports 49 that it covers. The term "semi-cylindrical" means partially cylindrical, not just a cylinder extending 180 degrees. In the example of FIG. 3, semi-cylindrical portion 53 extends around intake housing 39 about 240 degrees relative to centerline 55. In other embodiments, the circumferential extent may be as little as 120 degrees. The radius r1 of semi-cylindrical portion 53 is formed about centerline 55, which coincides with the axis of intake housing 39 and of pump 19 (FIG. 1). Radius r1 has a single or fixed dimension. Since semi-cylindrical portion 53 extends greater than 180 degrees in this embodiment, it cannot be simply lifted upward or moved away from intake housing 39 in a direction perpendicular to centerline 55. Gas restrictor 51 is installed on intake housing 39 by sliding it axially on intake housing 39 with second standoff end 45 removed, then securing second standoff end 45.

Gas restrictor 51 has a counterweight portion 57 extending eccentrically from semi-cylindrical portion 53. Counterweight portion 57 serves to cause semi-cylindrical portion 53 to self orient so as to be on the upper side of intake housing 39. During installation, intake housing 39 typically will rotate some along with ESP 17 as ESP 17 is being run into well 11. In this embodiment, counterweight portion 57 has side walls 59 that join or are integrally formed with the lower edges of semi-cylindrical portion 53. Side walls 59 are illustrated as being flat and parallel with each other, but that configuration could vary. Side walls 59 may thus be in vertical planes parallel with a vertical plane passing through centerline 55. The lower edges of side walls 59 are joined to each other by an outboard area or portion 61. Outboard portion 61 may be partially cylindrical and is spaced above the lower portion of outer housing 35. Outboard portion 61 is illustrated as being formed at a fixed radius r2 about centerline 55 that is greater than radius r1 of semi-cylindrical portion 53.

At least one weight bar 63 (two shown) is mounted to outboard portion 61, such as by welding to the upper side of outboard portion 61. Each weight bar 63 extends along the length of gas restrictor 51, preferably the full length. Well fluid ports 65 are located in outboard portion 61 in this example, on each side of weight bars 63. Well fluid ports 65 may be closer to outer housing 35 than to intake housing 39. Weight bars 63 having centerlines located a distance from centerline 55 that is greater than radius r1 and slightly less than radius r2. The weight of weight bars 63 and their outboard location create a center of gravity 67 for gas restrictor 51 that is located below semi-cylindrical portion centerline 55, which is the same as the axis of intake housing 39. As a result, gravity will cause gas restrictor 51 to swing relative to intake housing 39 to the position shown in FIG. 3, with center of gravity 67 in a vertical plane below centerline 55.

In the operation of the embodiment of FIGS. 1-3, as ESP 17 is lowered into casing 13 and pushed into the horizontal section of well 11, it will tend to rotate about its axis to some extent. While in the vertical portion of well 11, gas restrictor sleeve 51 remains positioned coaxially on intake housing 39 because semi-cylindrical portion 53 extends more than 180 degrees around intake housing 39. In the horizontal portion of well 11, gravity causes weight bars 63 to orient below intake housing 39, as shown in FIG. 3. In this position, all of the intake housing ports 49 located above 180 degrees are blocked by the close engagement of semi-cylindrical portion 53 on intake housing 39.

Once installed, the operator supplies power to motor 25, which drives pump 19. Well fluid, including liquid and gas, flows horizontally from perforations to intake assembly 21. The gas within the horizontal section tends to migrate upward. Gas restrictor 51 prevents gas above intake housing 39 from flowing downward through the intake housing ports 49 being blocked by semi-cylindrical portion 53. Principally liquid will flow through outer housing ports 37, particularly those on the lower side, into outer annulus 40. As indicated by the arrows, the liquid flows through gas restrictor ports 65, the intake housing ports 49 on the lower side of intake housing 39, and into inner annulus 42. The liquid flows from inner annulus 42 into pump 19. While some gas may flow through outer housing ports 37 on the upper side into outer annulus 40, the lighter gravity tends to prevent the gas from being entrained with the liquid and flowing through gas restrictor ports 65, which are located only in the lower portion of outer annulus 40.

Seal ring 43 and standoffs 41, 45 prevent well fluid from bypassing intake housing 39 as it flows into pump 19. Even if the flow rate through gas restrictor ports 65 is quite high, gas restrictor 51 remains in the position of FIG. 3, blocking flow through intake ports 49 on the upper portion of intake housing 39. The greater than 180 degree extent of semi-cylindrical portion 53 plus weight bars 63 maintain gas restrictor 51 in the desired position.

Figure 4:
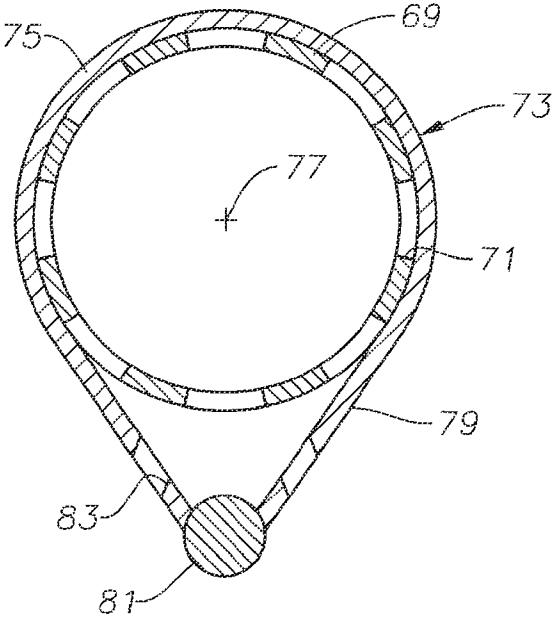
FIG. 4 is a transverse sectional view of a second embodiment of the intake of the pump assembly of FIG. 1, with the well casing and outer housing of the intake not shown.

In the second embodiment, shown in FIG. 4, intake housing 69 has intake ports 71 and is the same as the first embodiment intake housing 39. Gas restrictor 73 has a semi-cylindrical portion 75 with a centerline 77 coinciding with the axis of intake housing 69. Semi-cylindrical portion 75 extends circumferentially a little more than 180 degrees in this embodiment, but that can vary. Counterweight portion 79 has converging side walls joining semi-cylindrical portion 75. The converging side walls join each other in an outboard portion having a weight bar 81. Gas restrictor ports 83 are located in the converging side wall portions. The outboard portion is located farther from centerline 77 that semi-cylindrical portion 75. The embodiment of FIG. 4 operates in the same manner as the embodiment of FIGS. 2 and 3.

Figure 5:
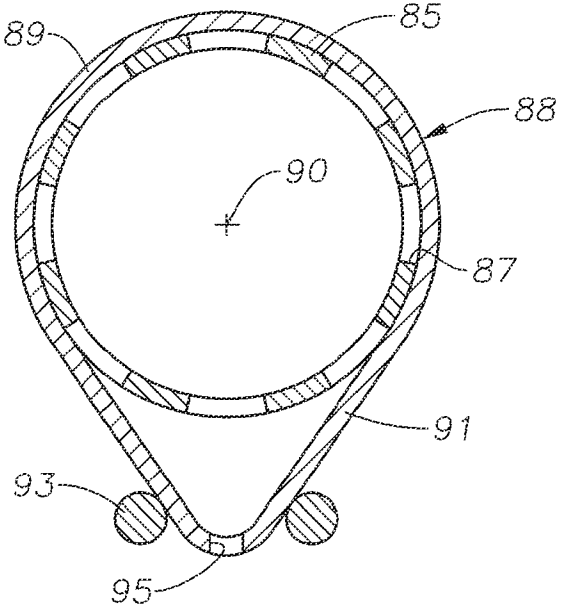
FIG. 5 is a transverse sectional view of a third embodiment of the intake of the pump assembly of FIG. 1, with the well casing and outer housing of the intake not shown.

In the third embodiment of FIG. 5, intake housing 85 has intake ports 87 and is the same as in the embodiments of FIGS. 2-4. Gas restrictor 88 has a semi-cylindrical portion 89 formed about a centerline 90 that coincides with the axis of intake housing 85. The fixed radius of semi-cylindrical portion 89 extends circumferentially a little more than 180 degrees, but that can vary. Counterweight portion 91 extends eccentrically from semi-cylindrical portion 89. Two generally straight side walls converge to an apex or farthest outboard portion. A weight bar 93 is mounted to the outer side of each converging side wall in close proximity to the outboard portion. A gas restrictor port 95 extends through the outboard portion, vertically below centerline 90. The third embodiment operates in the same manner as the embodiments of FIGS. 2-4.

Figure 6:
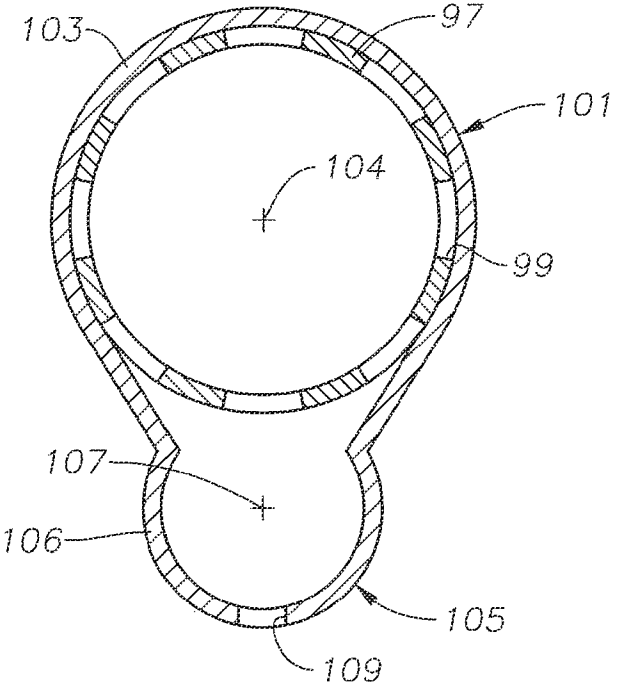
FIG. 6 is a transverse sectional view of a fourth embodiment of the intake of the pump assembly of FIG. 1, with the well casing and outer housing of the intake not shown.

In the fourth embodiment of FIG. 6, intake housing 97 has intake ports 99 and is the same as in the other embodiments. Gas restrictor 101 has an upper semi-cylindrical portion 103 formed at a single radius about an upper centerline 104 coinciding with the axis of intake housing 97. The single radius extends circumferentially about 240 degrees, but that can vary. Counterweight portion 105 extends outward eccentrically from upper semi-cylindrical portion 103. Counterweight portion 105 comprises a lower partially or semi-cylindrical portion 106 having a radius formed about a lower centerline 107 that is located below centerline 104. The radius of lower semi-cylindrical portion 106 is smaller than the radius of upper semi-cylindrical portion 103. Lower semi-cylindrical portion 106 extends about 240 degrees about lower centerline 107. The interior of lower semi-cylindrical portion 106 is in fluid communication with the interior of upper semi-cylindrical portion 103.

Gas restrictor 101 will self orient by gravity to place lower centerline 107 vertically below intake housing 97. Counterweight portion 105 has gas restrictor ports 109 vertically below upper semi-cylindrical portion centerline 104. The weight of counterweight portion 105 and its outboard extremity are sufficient to position the center of gravity of gas restrictor 101 well below upper centerline 104. A weight bar is not required in the embodiment of FIG. 6 to cause gas restrictor 103 to swing by gravity to the position shown in FIG. 6. The fourth embodiment operates in the same manner as the embodiments of FIGS. 2-5.

While the disclosure has been shown in only a few of its forms, it should be apparent to those skilled in the art that it is not so limited but is susceptible to various changes without departing from the scope of the disclosure.

The invention claimed is:

1. A submersible pump assembly for operation within a horizontal section of a well, comprising:

a plurality of modules secured together, the modules including a pump having a longitudinal axis and a motor for driving the pump;

an intake assembly operatively connected with the pump and comprising:

a tubular intake housing concentric with the axis, the intake housing containing a plurality of intake housing ports;

a gas restrictor carried around and rotatable relative to the intake housing; the gas restrictor comprising:

a semi-cylindrical portion having a semi-cylindrical portion centerline, the semi-cylindrical portion closely receiving the intake housing;

a counterweight portion connected with the semi-cylindrical portion, the counterweight portion being configured to place a center of gravity of the gas restrictor below the semi-cylindrical portion centerline, causing the semi-cylindrical portion to overlie and block at least one of the intake housing ports located in an upper portion of the intake housing while the pump assembly is horizontally oriented; and at least one gas restrictor port in the gas restrictor to admit well fluid to at least one of the intake housing ports located on a lower portion of the intake housing.

2. The pump assembly according to claim 1, wherein the gas restrictor port extends through the counterweight portion.

3. The pump assembly according to claim 1, wherein the semi-cylindrical portion extends at a single radius about the semi-cylindrical portion greater than 180 degrees.

4. The pump assembly according to claim 1, wherein the counterweight portion has an outermost point that is located radially farther from the semi-cylindrical portion centerline than the semi-cylindrical portion.

5. The pump assembly according to claim 1, wherein the counterweight portion comprises:

first and second side walls extending downward from opposite sides of the semi-cylindrical portion and joining each other at a distance from the semi-cylindrical portion centerline greater than a radius of the semi-cylindrical portion.

6. The pump assembly according to claim 1, wherein the counterweight portion comprises:

a weight bar having a weight bar centerline located farther from the semi-cylindrical portion centerline than the semi-cylindrical portion.

7. The pump assembly according to claim 1, wherein the counterweight portion comprises:

first and second side walls extending downward from opposite sides of the semi-cylindrical portion and joining each other at an outboard area that is at a radius from the semi-cylindrical portion centerline greater than a radius of the semi-cylindrical portion;

a weight bar secured to the outboard area; and wherein the at least one gas restrictor port is located in outboard area.

8. The pump assembly according to claim 1, wherein the counterweight portion comprises:

first and second side walls extending downward from opposite sides of the semi-cylindrical portion and joining each other at in an outboard area a distance from the semi-cylindrical portion centerline greater than a radius of the semi-cylindrical portion;

a weight bar secured to an upward-facing surface of the outboard area; and wherein the at least one gas restrictor port is located in outboard area.

9. The pump assembly according to claim 1, wherein:

the intake assembly is connected between two of the modules;

the intake housing has a smaller outer diameter than said two of the modules; and the counterweight portion has an outboard area that is located a distance from the axis than is less than a radius of said two of the modules.

10. A submersible pump assembly for operation within a horizontal section of a well, comprising:

a plurality of modules secured together, the modules including a pump having a longitudinal axis and a motor for driving the pump;

an intake assembly operatively connected with the pump and comprising:

a tubular intake housing concentric with the axis, the intake housing containing a plurality of intake housing ports and having an outer diameter less than an outer diameter of said two of the modules;

a gas restrictor carried around the intake housing, the gas restrictor being an eccentric sleeve comprising:

a semi-cylindrical portion free of apertures and having a semi-cylindrical portion centerline coincident with the axis of the pump, the semi-cylindrical portion extending around an upper portion of the intake housing;

a counterweight portion connected with the semi-cylindrical portion, the counterweight portion having an outboard area farther from the semi-cylindrical portion centerline than the semi-cylindrical portion;

wherein the gas restrictor is free to self orient relative to the intake housing due to gravity while the pump assembly is in the horizontal section of the well, with the semi-cylindrical portion overlying and blocking at least some of the intake housing ports on an upper portion of the intake housing; and at least one gas restrictor port in the counterweight portion to admit well fluid to the intake housing ports located on a lower portion of the intake housing.

11. The pump assembly according to claim 10, wherein the counterweight portion comprises:

a weight bar having a weight bar centerline located farther from the semi-cylindrical portion centerline than the semi-cylindrical portion.

12. The pump assembly according to claim 10, wherein the counterweight portion comprises:

first and second side walls extending downward from opposite sides of the semi-cylindrical portion and joining each other at an outboard area that is a distance from the semi-cylindrical portion centerline greater than a radius of the semi-cylindrical portion; and a weight bar secured to the outboard area.

13. The pump assembly according to claim 10, wherein the counterweight portion comprises:

a weight bar secured to the outboard area having sufficient weight to position a center of gravity of the gas restrictor below the axis of the pump.

14. The pump assembly according to claim 10, further comprising:

an outer housing connected between said two of the modules, surrounding the intake housing and having a same outer diameter as said two of the modules; and a plurality of outer housing ports in the outer housing to admit well fluid to the intake housing ports.

15. The pump assembly according to claim 10, further comprising:

an outer housing connected between said two of the modules, surrounding the intake housing and having a same outer diameter as said two of the modules;

a plurality of outer housing ports in the outer housing to admit well fluid to the intake housing ports; and wherein a lower side of the outboard area of the counterweight portion is spaced above a lower portion of an inner diameter surface of the outer housing.

16. The pump assembly according to claim 10, wherein the semi-cylindrical portion has a circumferential extent that is in a range from 120 to 240 degrees.

17. The pump assembly according to claim 10, wherein the counterweight portion comprises:

a partially cylindrical portion joined to the semi-cylindrical portion, the partially-cylindrical portion having a partially-cylindrical portion centerline located below the intake housing, and the partially-cylindrical portion and the semi-cylindrical portion having interiors in fluid communication with each other.

18. A method of pumping well fluid from a horizontal section of a well, comprising:

providing a pump assembly with a longitudinal axis and an intake housing containing a plurality of intake housing ports;

providing a gas restrictor with a semi-cylindrical portion and a counterweight portion, the semi-cylindrical portion having a centerline, and the gas restrictor having a gas restrictor port;

mounting the gas restrictor around the intake housing;

running the pump assembly into the horizontal section of the well;

allowing the gas restrictor to swing by gravity relative to the intake housing to a position that places a centerline of the semi-cylindrical portion coincident with the axis of the pump and places a center of gravity of the gas restrictor below the centerline, causing the semi-cylindrical portion to overlie and block at least one of the intake housing ports located in an upper portion of the intake housing; and operating the pump assembly, causing well fluid to flow through the gas restrictor port and through at least one of the intake housing ports located on a lower portion of the intake housing.

19. The method according to claim 18, wherein providing a gas restrictor comprises providing an eccentric sleeve.

20. The method according to claim 18, wherein providing a gas restrictor comprises providing an eccentric sleeve having an outboard area located farther from the centerline than the semi-cylindrical portion, and mounting a weight bar to the outboard area.

* * * * *